US005294172A

United States Patent [19]

Dubus

[11] Patent Number: 5,294,172

[45] Date of Patent: Mar. 15, 1994

[54] CHILD'S FOOD TRAY WITH SEE-THROUGH ENCLOSED INTERACTIVE ACTIVITY CHAMBER

[76] Inventor: Susan E. Dubus, R.R. 1, Box 79, Rolfe, Iowa 50581

[21] Appl. No.: 757,963

[22] Filed: Sep. 12, 1991

[51] Int. Cl.[5] ..... A47B 83/02

[52] U.S. Cl. ..... 297/148; 297/217; 297/256.15; 446/227

[58] Field of Search ..... 297/148, 149, 150, 151, 297/153, 217, 250; 273/118 R, 119 R, 120, 121, 121 D, 122 R; 446/227 X, 482; 272/1 R, 1 A

[56] References Cited

U.S. PATENT DOCUMENTS

| | | | |
|---|---|---|---|
| 602,215 | 4/1898 | Foster | 446/227 |
| 1,222,455 | 4/1917 | Packwood . | |
| 2,402,861 | 6/1946 | Winnick | 46/32 |
| 2,762,161 | 9/1956 | Danielson | 446/227 |
| 3,204,367 | 9/1965 | Stubbmann | 446/227 |
| 3,224,776 | 12/1965 | Mehelich | 273/121 R |
| 3,512,297 | 5/1970 | Malherbe et al. | 297/148 X |
| 4,057,244 | 11/1977 | Gaspar | 446/482 X |
| 4,095,843 | 6/1978 | Hirsch | 297/345 |
| 4,606,576 | 8/1986 | Jones | 297/148 X |
| 4,738,888 | 4/1988 | Pantaleo et al. | 215/100.5 |
| 4,936,628 | 6/1990 | Delaney et al. | 297/250 |

FOREIGN PATENT DOCUMENTS 513661 6/1955 Canada .

OTHER PUBLICATIONS

1958 Pic*A*Game Table page.

*Primary Examiner*—James R. Brittain
*Assistant Examiner*—Milton Nelson, Jr.
*Attorney, Agent, or Firm*—Zarley, McKee, Thomte, Voorhees, & Sease

[57] ABSTRACT

A conventional high chair food tray is provided with an activity chamber below a transparent top which is sealed against access by a child but includes an exterior control mechanisms for operating moveable pieces in the activity chamber. An example is a pinball game with exterior shooters for moving balls around inside the activity chamber for actuating items such as a paddle wheel. The food tray may be utilized with a car seat as well.

18 Claims, 1 Drawing Sheet

CHILD'S FOOD TRAY WITH SEE-THROUGH ENCLOSED INTERACTIVE ACTIVITY CHAMBER

BACKGROUND OF THE INVENTION

Young children in high chairs in restaurants can become a distraction to nearby persons if the child is not kept quietly occupied. What is needed then is a high chair with a food tray that has entertainment for the child built into it that is physically inaccessible by the child thereby preventing it from being rendered inoperative.

SUMMARY OF THE INVENTION

A food tray has built into it an activity chamber which includes moveable components controllable by the child only from the outside of the chamber. The top of the food tray is transparent so that the child has full view of activities within the chamber. The top wall is of a sufficiently rigid material to serve as a food table from which the child can eat. The operating controls are within easy reach of the child but access to the interior of the chamber is prevented thereby avoiding the components in the chamber being lost and destroyed or made inoperable. There is a tendency for a child to toss away any toy like item that can be reached and played with.

An example of an activity within the enclosed chamber is a pinball type game which includes actuators on opposite sides for shooting balls around in the chamber which in turn actuate a variety of different items for the entertainment of the child. Such items, by the way of example, would be a paddle wheel which would be rotated upon being engaged by a moving ball. A watering can could be caused to tip and simulate watering of a flowerpot upon being hit by a ball. A dog could be caused to come out of a doghouse upon the house being hit by a ball. The balls would return to the shooters by the tray being sloped towards the child and the balls returning to the shooters by gravity.

The tray can be attached in a conventional manner to a high chair or used in conjunction with a car seat for travel in an automobile.

DESCRIPTION OF THE PREFERRED EMBODIMENT

Figure 1:
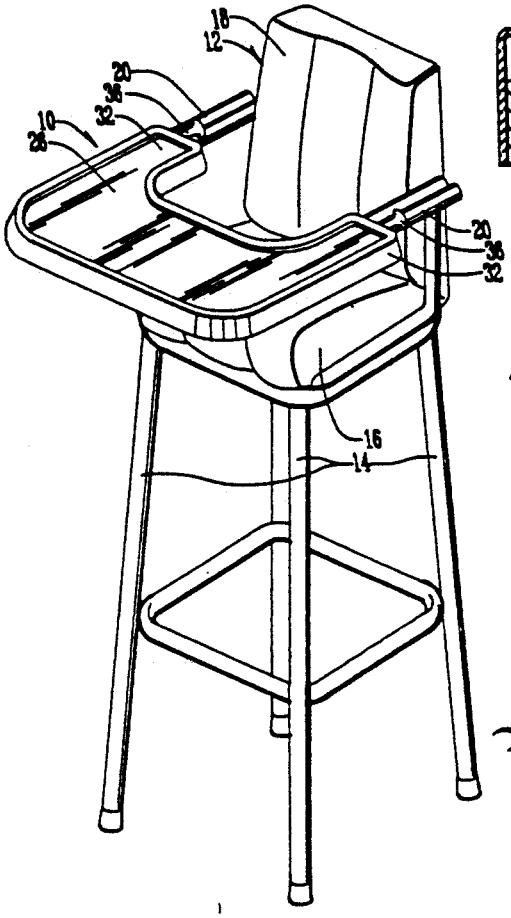
FIG. 1 is a perspective view of a high chair which includes the food tray of this invention.

The food tray of this invention is referred to generally by the reference numeral 10 and is shown in FIG. 1 on a high chair 12 having legs 14, a seat 16 and a back 18. The tray 10 is attached to arms 20 in a conventional fashion not disclosed.

Figure 3:
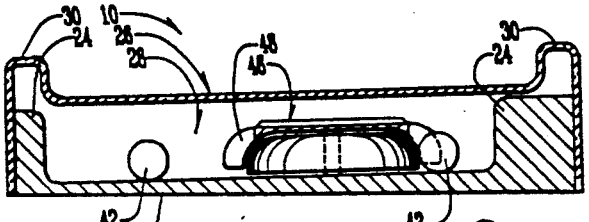
FIG. 3 is a cross sectional view taken along line 3—3 in FIG. 2.

The tray 10 as seen in FIG. 3 includes a base or bottom wall 22 which includes an upstanding perimeter wall 24. A transparent top 26 extends over the base 22 and defines an activity chamber 28. The top or cover 26 includes a peripheral shoulder or wall 30 which confines food to the transparent top area. The top is of a hard plastic material which is sufficiently rigid that it provides sufficient support for use by a child during eating and play.

The tray 10 is generally rectangular in shape but includes rearwardly extending side arms 32 which form a recessed area 34 therebetween along the edge nearest the child.

Figure 2:
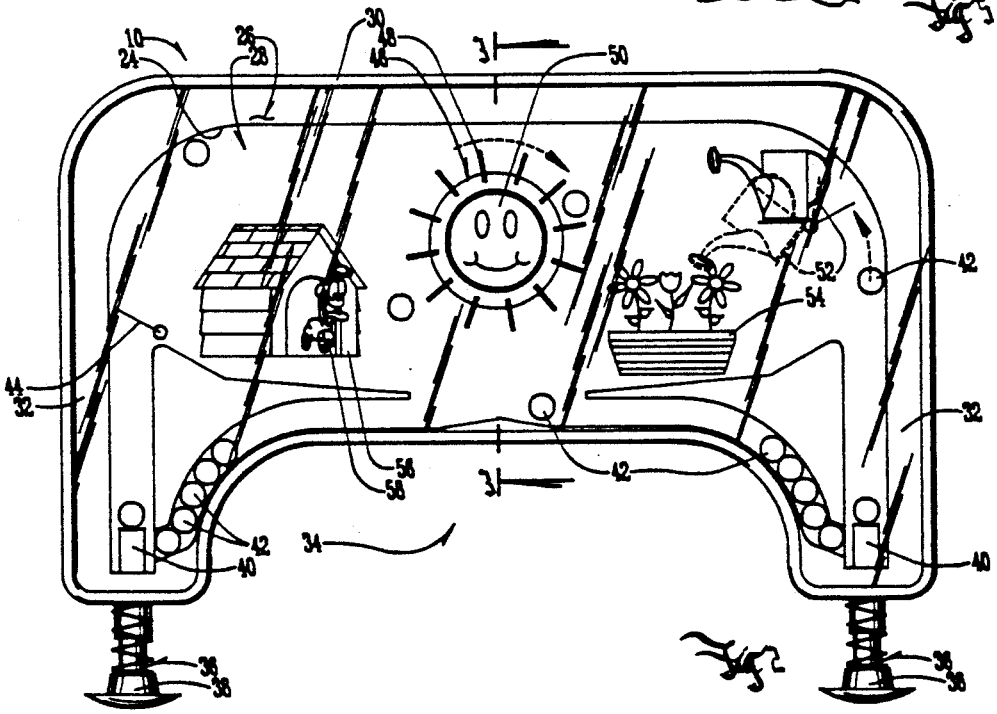
FIG. 2 is a top plan view thereof.

It is intended that any number of different games or other activities can be provided in the activity chamber 28. One example is a pinball type game which is shown in FIGS. 2 and 3. This game involves shooters 36 having handles 38 and ball actuators 40 being positioned in each of the arms 32. Balls 42 are held in return channels 44 and fed into the actuator 40 for moving about in the chamber 28. A one way gate 44 prevents the return of the balls directly to the actuator 40. Various items are provided in the activity chamber and include a paddle wheel 46 having a plurality of paddles 48 which upon being engaged by the ball 42 will cause the wheel to rotate. The ball engaging the dome 50 under the wheel 48 will sound a bell like alarm. A watering can 52 is pivotally mounted for being tipped by the ball 42 to simulate the watering of plants 54. The watering can will return to its upright position in response to a spring or the like not shown. A dog house 56 is shown in which a dog 58 would come out upon a ball hitting the dog house 56.

The base 22 as seen in FIG. 3 is sloped toward the side near the child thereby causing the balls 42 to return to the return channel 44 for being shot by the shooters 36.

Figure 4:
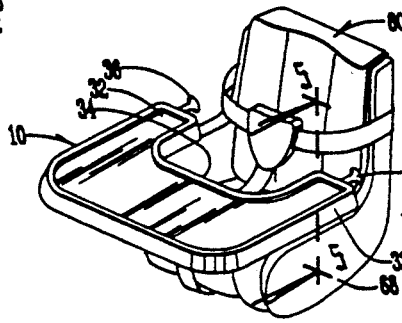
FIG. 4 is a perspective view of the food tray being used with a car seat.
Figure 5:
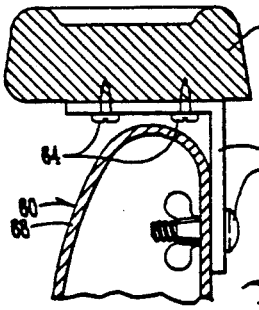
FIG. 5 is a cross sectional view taken along line 5—5 in FIG. 4.

The tray 10 may also be used with a car seat 60 as seen in FIG. 4 and is held in place by an L-shaped bracket 62 and a screw 64 attaching one leg of the bracket to the bottom tray arms 32. The other leg of the bracket 62 is held by a bolt with a wing nut 66 to the hollow arms 68 of the car seat 60.

It is thus seen in operation that a restaurant would provide its patrons with high chairs having the food tray of this invention which would serve as a table server for feeding the child but more importantly would keep the child entertained before, during and after eating. It is important that in the interior of the tray, out of the reach of the child, are mysterious activity pieces which the child can partially control from the outside. As shown in the example, a pinball type game may be utilized and the child can control this activity in the chamber 28 through operation of the externally mounted shooters 36. The tray cannot be damaged and cannot be made inoperative by the child but should provide endless hours of quiet entertainment freeing nearby adults from any disturbing distraction.

I claim:

1. A child's seat, including, a unitary food tray and see through activity chamber rigidly connected to said seat, said food tray having a base covered by a transparent food dish top and defining therebetween a fully enclosed entertainment activity chamber which is totally inaccessible to a child, activity means in said chamber fully viewable by the child through said transparent food dish top, and child actuated control means on said tray having a control element totally outside said chamber separably connected to said activity means in said chamber and said control element positioned to be readily accessible by a child in said seat.

2. The structure of claim 1 wherein said child's seat is defined as a high chair.

3. The structure of claim 1 wherein said child's seat is defined as a car seat.

4. The structure of claim 1 wherein the control element positioned to be readily accessible by a child in said seat is further defined as being the only control element on said tray separably connected to said activity means.

5. The structure of claim 1 wherein said combined unitary food tray and see through activity chamber is the only tray like means on said seat.

6. The structure of claim 1 wherein said activity means in said chamber includes a ball moveable in said chamber after being actuated by said control means.

7. The structure of claim 6 wherein is further defined as said control means a ball shooter on said tray and said control element is a handle on the outside of said tray and said ball shooter includes an actuator in said chamber for making contact with said ball and moving it about in said chamber.

8. The structure of claim 7 wherein said tray has front and back sides and opposite sides and said shooter is positioned in said back side.

9. The structure of claim 8 wherein said tray is further defined by said back side being U-shaped and having oppositely disposed arms at said opposite sides, and said ball shooter being in one of said arms.

10. The structure of claim 9 and a ball shooter is positioned in the other of said arms.

11. The structure of claim 10 said activity means includes a ball actuated moveable item in said chamber.

12. The structure of claim 11 wherein said ball actuated moveable item includes a paddle wheel rotatable upon being contacted by said ball.

13. The structure of claim 11 said base is sloped towards said back side for said ball to return to said shooter by action of gravity on said ball.

14. The structure of claim 1 wherein said transparent food dish top is further defined as being of substantially rigid material to serve as a child's food tray.

15. The structure of claim 14 wherein said transparent food dish top includes an upstanding peripheral shoulder.

16. The structure of claim 7 wherein said control element accessible by said child is further defined as being on the side of said tray facing the child setting in the seat.

17. The structure of claim 16 wherein the control element positioned to be readily accessible by a child in said seat is further defined as being the only control element on said tray separably connected to said activity means.

18. The structure of claim 17 wherein said combined unitary food tray and see through activity chamber is the only tray like means on said seat.

* * * * *